United States Patent [19]

Fujimura et al.

[11] Patent Number: 4,767,474

[45] **Date of Patent: * Aug. 30, 1988**

[54] ISOTROPIC MAGNETS AND PROCESS FOR PRODUCING SAME

[75] Inventors: Setsuo Fujimura, Kyoto; Masato Sagawa, Nagaokakyo; Yutaka Matsuura, Ibaraki, all of Japan

[73] Assignee: Sumitomo Special Metals Co., Ltd., Osaka, Japan

[ * ] Notice: The portion of the term of this patent subsequent to Jul. 22, 2003 has been disclaimed.

[21] Appl. No.: 567,008

[22] Filed: Dec. 30, 1983

[30] Foreign Application Priority Data

May 6, 1983 [JP] Japan ..... 58-79097
May 6, 1983 [JP] Japan ..... 58-79099

[51] Int. Cl.[4] ..... H01F 1/04

[52] U.S. Cl. ..... 148/302; 420/83; 420/121; 420/581; 75/244; 75/245; 75/246

[58] Field of Search ..... 148/31.57, 302; 75/123 B, 123 E, 244–246; 420/83, 121

[56] References Cited

U.S. PATENT DOCUMENTS

| | | | |
|---|---|---|---|
| 2,167,240 | 7/1939 | Hensel | 419/29 |
| 3,560,200 | 2/1971 | Nesbitt et al. | 75/122 |
| 3,684,593 | 8/1972 | Benz et al. | 148/102 |
| 4,063,970 | 12/1977 | Steingrover | 148/103 |
| 4,401,482 | 8/1983 | Green et al. | 148/104 |
| 4,402,770 | 9/1983 | Koon | 148/31.57 |
| 4,533,408 | 8/1985 | Koon | 148/103 |

FOREIGN PATENT DOCUMENTS

| | | | |
|---|---|---|---|
| 0046075 | 2/1982 | European Pat. Off. . | |
| 0106948 | 5/1984 | European Pat. Off. . | |
| 833049091 | 5/1984 | European Pat. Off. . | |
| 0126179 | 11/1984 | European Pat. Off. . | |
| 50-1397 | 1/1975 | Japan . | |
| 52-50598 | 4/1977 | Japan . | |
| 53-28018 | 3/1978 | Japan . | |
| 54-76419 | 6/1979 | Japan . | |
| 55-115304 | 9/1980 | Japan | 148/103 |
| 55-113304 | 9/1980 | Japan . | |
| 55-132004 | 10/1980 | Japan . | |
| 56-29639 | 3/1981 | Japan . | |
| 56-47538 | 4/1981 | Japan . | |
| 56-47542 | 4/1981 | Japan . | |
| 56-65954 | 6/1981 | Japan . | |
| 56-116844 | 9/1981 | Japan . | |
| 57-141901 | 9/1982 | Japan . | |
| 58-123853 | 7/1983 | Japan . | |
| 734597 | 8/1955 | United Kingdom . | |
| 2021147 | 11/1979 | United Kingdom . | |
| 2100286 | 12/1982 | United Kingdom . | |

OTHER PUBLICATIONS

IEEE Trans. on Magnetics., vol. MAG-18, No. 6, Nov. 1982, pp. 1448–1450, Koon et al., "Composition Dependence of the Coercive".

IEEE Trans. on Magnetics, vol. MAG-20, No. 5, part 2, Sep., 1984, pp. 1584–1589, Sagawa et al., "Permanent Magnet Materials . . . ".

Hadjipanaysis et al., "Electronic and Magnetic Properties of Rare-Earth-Transition-Metal Glasses", Sep. 27, 1979, pp. 101–107.

Croat, "Magnetic Hardening of Pr-Fe and Nd-Fe Alloys by Melt Spinning", J. Appl. Phys., Apr. 4, 1982, pp. 3161–3169.

"Powder Metallurgy-Applied Products (II)-Magnetic Materials", 1964.

Chikazumi et al., "Magnetic Body Handbook", 1975.

(List continued on next page.)

*Primary Examiner*—John P. Sheehan

*Attorney, Agent, or Firm*—Burns, Doane, Swecker & Mathis

[57] ABSTRACT

Isotropic permanet magnet formed of a sintered body having a mean crystal grain size of 1–130 microns and a major phase of tetragonal system comprising, in atomic percent, 10–25% of R wherein R represents at least one of rare-earth elements including Y, 3–23% of B, no more than 50% of Co and the balance being Fe. As additional elements M, Al, Ti, V, Cr, Mn, Zr, Hf, Nb, Ta, Mo, Ge, Sb, Sn, Bi, Ni or W may be incorporated.

The magnets can be produced through a powder meallurgical process resulting in high magnetic properties, e.g., up to 7 MGOe or higher energy product.

23 Claims, 13 Drawing Sheets

OTHER PUBLICATIONS

"Hard Magnetic Material", vol. 3, Magnetic Engineering Seminar, edited by Ida et al.
Kaneko et al., "Magnetic Materials", Nov. 1977.
"Magnetic Materials of Modern Age", edited by Mito-Kako-Gijutsu Kyokai, Jun. 5, 1981.
Croat, "Pr-Fe and Nd-Fe-Based Materials: A New Class of High-Performance Permanent Magnets", J. Appl. Phys., vol. 55, Mar. 15, 1984, pp. 2078-2082.
Chaban et al., "Ternary Nd, Sm, Gd-Fe-B Systems", LVOV State University, pp. 873-875.
Leamy et al., "The Structure of Co-Cu-Fe-Ce Permanent Magnets", IEEE Transactions on Magnetics, vol. MAG-9, No. 3, Sep. 1973, pp. 205-209.
Melton et al., "A Electron Microscope Study of Sm-Co-Cu-Based Magnetic Materials with the $Sm_2Co_{17}$ Structure", J. Appl. Phys., vol. 48, No. 6, Jun., 1977, pp. 2608-2611.
Senno et al., "Magnetic Properties of Sm-Co-Fe-Cu Alloys for Permanent Magnetic Materials", Japan J. Appl. Phys., vol. 14, (1975), No. 10, pp. 1619-1620.
Croat, "Preparation and Coercive Force of Melt-Spun Pr-Fe Alloys", Appl. Phys. Lett., vol. 37, Dec. 15, 1980, pp. 1096-1098.
Koon et al., "A New Class of Melt Quenched Amorphous Magnetic Alloys", Naval Research Lab., Washington, D.C., PACS No. 75.50Kj, 75.60Gm.
Koon et al., "Rare-Earth Transition Metal Exhange Interactions in Amorphous $(Fe_{0.82}B_{0.18})_{0.9}R_xLa_{0.1-x}$ Alloys", J. Appl. Phys., vol. 53, Mar. 1982, pp. 2333-2334.
Koon et al., "Magnetic Properties of Amorphous and Crystallized $(Fe_{0.82}B_{0.18})_{0.9}Tb_{0.05}La_{0.05}$", Appl. Phys. Lett., vol. 39, Nov. 15, 1981, pp. 640-642.
Handbook on the Physics and Chemistry of Rare Earths, vol. 2, Chapter 16, "Amorphous Magnetic Rare Earth Alloys", pp. 259-294.
Sagawa et al., "Permanent Magnet Materials Based on the Rare Earth-Iron-Boron Tetragonal Compounds", The Research Institute for Iron, Steel and Other Metals, Tohoku University, Japan.
Nezu et al., "$Sm_2(Co, Fe, Cu)_{17}$ Permanent Magnet Alloys with Additive Element Hf", pp. 437-449.
Koon et al., "Crystallization of FeB Alloys with Rare Earth to Produce Hard magnetic Materials", J. Appl. Phys., vol. 55, Mar. 15, 1984, pp. 2063-2066.
Croat et al., "High-Energy Produce Nd-Fe-B Permanent Magnets", Appl. Phys. Lett., vol. 44, Jan. 1984, pp. 148-149.
Hadjipanayis et al., "New Iron-Rare Earth Base Permanent Magnet Materials", Appl. Phys. Lett., vol. 43, Oct. 15, 1983, pp. 797-799.
El Masry et al., "Magnetic Moments and Coercive Forces in the Hexagonal Boride Homologous Series $Co_{2n+5}R_{n+1}B_{2n}$ with R=Gd and Sm", pp. 33-37.
Stadelmaier, "Cobalt-Free and Samarium-Free Permanent Magnet Materials Based on an Iron-Rare Earth Boride", Dept. of Materials Eng., N.C. State University, Sep. 1, 1983, pp. 1-9.
Herbst et al., "Relationships Between Crystal Structure and Magnetic Properties in $Nd_2Fe_{14}$ B", Phys. Dept., General Motors Res. Lab., pp. 1-10.
Stadelmaier, "The Neodymium-Iron Permanent Magnet Breakthrough", Magnetic Materials Products Assoc., Jan. 1984, pp. 1-15.
Topp, "The Chemistry of the Rare-Earth Elements", Topics in In-Organic and General Chemistry, 1965, pp. 1-12.
El Masry et al., "Substitution of Iron for Cobalt in Rare Earth Boride Permanent Magnets of the Type $Co_{3n+5}Sm_{n+1}B_{3n}$", Dept. of Materials, N.C. State Un., Feb., 1983, pp. 86-88.
El Masry et al., "Phase Equilibria in the Co-Sm-B System", Journal of the Less-Common Metals vol. 96, Jan., 1984, pp. 165-170.
Robinson, "Powerful New Magnet Material Found", Science, vol. 233, Mar. 2, 1984, pp. 920-922.
Givord et al., "Magnetic Properties and Crystal Structure of $Nd_2Fe_{14}B$", Solid State Comm., vol. 50, No. 6, Feb., 1984, pp. 497-499.
Nagel et al., "Influence of Cu-Content on the Hard Magnetic Properties of Sm(co,Cu) 2:17 Compounds", IEEE Transactions on Magnetics, vol. MAG-14, No. 5, Sep. 1978, pp. 671-673.
Ojima et al., "Magnetic Properties of a New Type of Rare-Earth Cobalt Magnets: $Sm_2(CO,Cu,Fe,M)_{17}38$ , IEEE Transactions on Magnetic, vol. MAG-13, No. 5, Sep., 1977, pp. 1317-1319.
Gupta et al., "Magnetization Process and Reversal in $Sm_3Co_{11}B_4$", Journal of Magnetism and Magnetic Materials, vol. 40, 1983, pp. 32-36.
Chikazumi, "Physics of Magnetism", pp. 18, 498-499.
Lee, "Hot-Pressed Neodymium-Iron-Boron Magnets",

OTHER PUBLICATIONS

Appl. Phys. Lett., Vol. 46, April 15, 1985, pgs. 790–791.

Burzo, "Some New Results in the Field of Magnetism of Rare Earth Compounds", Acta Physica Polonica, March, 1985, pgs. 1–17 w/drawings.

Sagawa et al, "New Material for Permanent Magnets on a Base of Nd and Fe", J. Appl. Phys., Vol. 55, March 15, 1984, pgs. 2083.

Kabacoff et al, "Thermal and Magnetic Properties of Amorphous $Pr_x(fe_{0.8}B_{0.2})_{1-x}$", J. Appl. Phys., Vol. 53, March, 1982, pgs. 2255–2257.

J.J. Croat, "Permanent Magnet Properties of Rapidly Quenched Rare Earth-Iron Alloys", IEEE Trans. Mag., Vol. MAG-18, No. 6, Nov., 1982, pg. 1442–1447.

R.K. Mishra, "Microstructure of Melt-Spun Neodymium-Iron-Boron Magnets", International Conference on Magnetism 1985.

Mainichi Daily News, Saturday, June 4, 1983, "Strongest Magnet Unveiled".

Japanese High Technology, Aug. 1984, Vol. 4, No. 5. "NEOMAX—NEODIMIUM IRON MAGNET—", Sumitomo Special Metals Co., Ltd.

Hadjipanayis et al, "Investigation of Crystalline Iron-Platinum Nickel and Amorphous Rare-Earth Alloys for Permanent Magnets", March 15, 1983, pgs. 1–79 w/Appendix.

Koo, "Partial Substitution of Sm with Neodymium, Praseodymium, and Mischmetal in $RE_2TM_{17}$ Permanent Magnets", IEEE Transactions on Magnetics, Vol. MAG-20, No. 5, Sept. 1984, pgs. 1593–1595.

Givord et al, "Crystal Chemistry and Magnetic Properties of the $R_2Fe_{14}B$ Family of Compounds", Oct. 25, 1984, pgs. 131–142.

Greedan et al, "An Analysis of the Rare Earth Contribution to the Magnetic Anistropy in $RCo_5$ and $R_2Co_{17}$ Compounds", Journal of Solid State Chemistry, Vol. 6, 1973, pgs. 387–395.

Ray et al, "Easy Directions of Magnetization in Ternary $R_2(Co,Fe)$ Phases", IEEE Transactions on Magnetics, Sept. 1972, pgs. 516–518.

Lee, "The Future of Rare Earth-Transition Metal Magnets of Type $RE_2TM_{17}$", J. Appl. Phys., Vol. 52, March, 1981, pgs. 2549–2553.

Ohashi et al, "Effects of Prasedymium Substitution on Precipitation Hardened Rare Earth Magnets", pgs. 493–501.

Ormerod, "Processing and Physical Metallurgy of NdFeB and Other Rare Earth Magnets", pgs. 69–92.

Handbook on the Physics and Chemistry of Rare Earths, Vol. 2, Chapter 15, pgs. 231–241.

Handbook on the Physics and Chemistry of Rare Earths, Vol. 2, Chapter 14, pgs. 55–56, 155–161.

Neumann et al, "Line Start Motors Designed with Nd-Fe-B Permanent Magnets", pgs. 77–89.

Fe-10Co-8B-x·Nd-1W

ISOTROPIC MAGNETS AND PROCESS FOR PRODUCING SAME

FIELD OF THE INVENTION

The present invention relates generally to isotropic permanent magnets and, more particularly, to novel magnets based on FeCoBR alloys and expressed in terms of FeCoBR and FeCoBRM.

In the present disclosure, the term "isotropy" or "isotropic" is used with respect to magnetic properties. In the present invention, R is used as a symbol to indicate rare-earth elements including yttrium Y, M is used as a symbol to denote additional elements such as Al, Ti, V, Cr, Mn, Zr, Hf, Nb, Ta, Mo, Ge, Sb, Sn, Bi, Ni and W, and A is used as a symbol to refer to elements such as copper Cu, phosphorus P, carbon C, sulfur S, calcium Ca, magnesium Mg, oxygen O and silicon Si.

BACKGROUND OF THE INVENTION

Permanent magnets are one functional material which is practically indispensable for electronic equipments. The permanent magnets currently in use mainly include alnico magnets, ferrite magnets, rare earth-cobalt (RCo) magnets and more. With remarkable advances in semiconductor devices in recent years, it is increasingly required to miniaturize and upgrade the parts corresponding to hands and feet or mouths (voice output devices) thereof. The permanent magnets used therefor are required to possess high properties, correspondingly.

Although, among permanent magnets, the isotropic permanent magnets are inferior to the anisotropic magnets in certain points in view of performance, the former magnets find good use due to such magnetic properties that no limitation is imposed upon the shape and the direction of magnetization. However, there is much to be desired in performance. The anisotropic magnets rather than the isotropic magnets are generally put to practical use due to high performance. Although the isotropic magnets are substantially formed of the same material as the anisotropic magnets, for instance, alinco magnets, ferrite magnets, MnAl magnets and FeCrCo magnets show a maximum energy product (BH)max of barely 2 MGOe. SmCo magnets broken down into RCo magnets show a relatively high value on the order of 4–5 MGOe, which is nonetheless only ¼–1/5 times those of the anisotropic magnets. In addition, the SmCo magnets still offer some problems in connection with practicality, since they are very expensive, because samarium Sm which is not abundant is needed, and it is required to use a large amount, i.e., 50–60 weight % of cobalt Co, the supply of which is uncertain.

It has been desired in the art to use relatively abundant light rare earth element such as Ce, Nd and Pr in place of Sm belonging to heavy rare earth and substitute Co with Fe. However, it is well-known that light rare earth and Fe do not give rise to intermetallic compounds suitable for magnets, even when they are mutually melted in a homogeneous state, and crystallized by cooling. Furthermore, an attempt made to strengthen the magnetic force of such light rare earth-Fe alloys was also unsuccessful (see JP Patent Kokai (Laid-Open) Publication No. 57 (1982)-210934, pp.6).

On the other hand, it is known that amorphous alloys based on (Fe, Ni, Co)-R can be obtained by melt-quenching. In particular, it has been proposed (in the aforesaid Publication No. 57-210934) to prepare amorphous ribbons from binary alloys based FeR (as R use is made of Ce, Pr, Nd, Sm, Eu, etc.), especially FeNd and magnetizing the ribbons, whereby magnets are obtained. This process yields magnets having (BH)max of 4–5 MGOe. However, since the resulting ribbons have a thickness ranging from several microns to several tens microns, they should be pressed upon pulverization or laminated in order to obtain magnets of practical bulk. With any existing manners, a lowering of theoretical density and a further lowering of magnetic properties would not be avoided. After all, it is unfeasible to introduce improvements in magnetic properties.

SUMMARY OF THE DISCLOSURE

The present invention has for its principal object to provide novel practical permanent magnets superseding the conventional isotropic permanent magnet materials.

In particular, the present invention aims at providing isotropic permanent magnets (materials) in which relatively abundant materials (especially Fe and as R relatively abundant light rare earth) can be used, particularly without necessarily recourse to scarce and expensive Sm, etc., and a large amount of Co is not necessarily employed, and which possess magnetic properties equivalent to, or greater than, those of the prior art ferrite and sufficiently high Curie points (or low temperature dependence) in view of practicality.

The present invention further contemplates providing a process for the production of such magnets.

The present inventors made an examination of the sintered bodies of FeR and FeBR obtained by the powder metallurgical procedures. As a result, the FeR systems were found to have only Hc and (BH)max close to zero, but the FeBR systems provided permanent magnets having such high properties as not achieved in the prior art, as long as they were within a specific compositional range, and were prepared according to a specific process of production.

The present inventors developed permanent magnets formed of magnetically anisotropic sintered bodies of the FeBR and FeBRM systems based on the FeBR base alloys (U.S. patent application Ser. No. 510,234 filed on July 1, 1983 now abandoned).

Further, the present inventors have developed permanent magnets formed of magnetically isotropic sintered bodies of the FeBR and FeBRM systems, which are disclosed in a concurrent application.

Such isotropic permanent magnets based on Fe, B and R are excellent in that they are free from Co, use as R relatively abundant light rare earth elements, mainly neodymium Nd and praseodymium Pr, contain Fe as the main component, and show an extremely high energy product reaching as high as 9 MGOe or even higher. Compared with the conventional alnico and RCo magnets, these permanent magnets based on Fe, B and R are very useful as such, since they possess higher properties at lower costs, in other words, give high cost performance.

The FeBR base isotropic permanent magnets have Curie points of generally about 300 degrees C. and at most 370 degrees C. Such Curie points are lower than the Curie points, 800 degrees C., of the alnico or RCo base permanent magnets.

Concretely speaking, the gist of the present invention is to improve the temperature dependence of FeBR base isotropic magnets.

According to the present invention, a part of the main component Fe of the FeBR and FeBRM base magnets is substituted with Co, thereby increasing the Curie points of the resulting alloys and hence improving (i.e., lowering) the temperature dependence thereof.

It is thus possible to obtain magnetically isotropic sintered permanent magnets, which have sufficiently high Curie points in view of practicality and, moreover, possess magnetic properties equivalent to, or greater than, those of the hard ferrite magnets, from practical raw materials with the application of practical processes of production.

According to the 1st–3rd aspects of the present invention, there are provided magnetically isotropic sintered permanent magnets based on FeCoBR. More specifically, according to the 1st aspect, there is provided an isotropic sintered permanent magnet based on FeCoBR; according to the 2nd aspect, there is provided an FeCoBR base magnet, the mean crystal grain size of which ranges from 1 to 130 microns after sintering; and according to the 3rd aspect, there is provided a process for the production of the FeCoBR base, isotropic sintered permanent magnets.

The 4th–6th aspects of the present invention relates to FeCoBRM systems. More specifically, according to the 4th aspect, there is provided an isotropic permanent magnet based on FeCoBRM; according to the 5th aspect, there is provided an FeCoBRM base magnet, the mean crystal grain size of which ranges from 1 to 100 microns after sintering; and according to the 6th aspect, there is provided a procss for the production of the magnets according to the 4th and 5th aspects.

The 7th aspect of the present invention is concerned with an allowable level of impurities, which is applicable to the FeCoBR and FeCoBRM systems alike, and offers advantages in view of the practical products and the process of production thereof as well as commercial productivity.

In the present disclosure, "%" means "atomic %" unless otherwise specified.

Thus, the 1st aspect of the present invention provides magnetically isotropic permanent magnets formed of sintered bodies comprised of, in atomic %, 10–25% of R (wherein R denotes at least one of rare-earth elements including Y), 3–23% of B, 50% or less of Co (exclusive of 0% of Co), and the balance being Fe and inevitable impurities (hereinafter referred to as the FeCoBR compositions or systems). Thereby the temperature dependence thereof can substantially be improved to the same level as being achieved in the conventional alnico and RCo magnets.

In the present invention, the FeBR base permanent magnets can be improved in respect of the temperature dependence thereof due to the presence of Co, and in respect of the magnetic properties thereof by way of the use of relatively abundant rare-earth elements such as Nd and Pr as the rare-earth elements R. For that reason, the permanent magnets of the present invention offer advantages over the conventional RCo magnets in view of resources and prices and, besides, excel further in magnetic properties.

The 2nd aspect of the present invention provides isotropic permanent magnets having the FeCoBR compositions, in which the sintered bodies have a mean crystal grain size ranging from 1 to 130 microns after sintering. (The process of production according to the 3rd aspect will be described later with reference to the 6th aspect of the invention).

The isotropic permanent magnets according to the 4th aspect of the present invention is comprised of an FeCoBRM composition comprising, in atomic %, 10–25% R (wherein R denotes at least one rare-earth elements including Y), 3–23% of boron B, 50% or less of Co, given percents, as stated below, of one or more of the following additional elements M (exclusive of 0% of M), and the balance being Fe and impurities inevitably entrained from the process of production, wherein M stands for:

| | |
|---|---|
| no more than 8.7% Al, | no more than 4.3% Ti, |
| no more than 8.7% V, | no more than 8.3% Cr, |
| no more than 8.0% Mn, | no more than 5.5% Zr, |
| no more than 5.0% Hf, | no more than 12.4% Nb, |
| no more than 10.3% Ta, | no more than 8.7% Mo, |
| no more than 5.7% Ge, | no more than 2.4% Sb, |
| no more than 3.5% Sn, | no more than 4.8% Bi, |
| no more than 4.3% Ni, and | no more than 8.8% W, |

provided that, when two or more elements M are added, the sum of M is no more than the maximum value among the values specified above of the elements M actually added.

According to the 7th aspect of the present invention, the isotropic sintered permanent magnets of the present invention may contain, in addition to FeCoBR or FeCoBRM, given percents of at least one of elements A, wherein A stands for no more than 3.3% copper Cu, no more than 2.5% sulfur S, no more than 4.0% carbon C, no more than 3.3% phosphorus P, no more than 4.0% calcium Ca and no more than 4.0% magnesium Mg, no more than 2.0% oxygen O, and no more than 5.0% silicon Si. However, the combined amount of A is no more than the maximum percent value among the percent values of the elements A actually entrained. It is noted that, when M and A are contained, the combined amount of (A+M) is not more than the atomic percent of one having the maximum value among the aforesaid values of the elements M and A actually added and contained. Such compositions will hereinafter be referred to as FeCoBRA or FeCoBRMA compositions or systems.

The present invention discloses as the 5th aspect thereof the FeCoBRM base permanent magnets of the 4th aspect, in which the mean crystal grain size of the sintered bodies is in a range of about 1 to 100 microns.

The permanent magnets of the present invention are obtained as magnetically isotropic sintered bodies, a process for the production of which is herein disclosed and characterized in that the respective alloy powders of the FeCoBR and FeCoBRM compositions are compacted under pressure, followed by sintering (the 3rd and 6th aspects). It is noted that the alloy powders are novel and crystalline rather than amorphous. For instance, the starting alloys are prepared by melting and cooled. The thus cooled alloys are pulverized, compacted under pressure and sintered to obtain isotropic permanent magnets. Cooling of the molten alloys may usually be done by casting and other cooling manners.

In the present invention, the term "isotropy" used to indicate one of the properties of the permanent magnets means that they are substantially isotropic, i.e., in the sense that no magnetic field is exerted during compacting, and also implies isotropy that may appear by compacting.

CRYSTAL STRUCTURE

The present inventors have already disclosed in detail the crystal structure of the magnetic materials and sintered magnets based on the FeBR base alloys in prior U.S. patent application Ser. No. 510,234 (filed on July 1, 1983) and FeCoBR base alloys in U.S. Ser. No. 516,841 (filed on July 25, 1983), the detailed disclosures of which are herewith referred to and incorporated herein, subject to the preponderance of the disclosure recited in this application. The same is also applied to FeCoBRM system.

Referring generally to the crystal structure, it is believed that the magnetic material and permanent magnets based on the FeCoBR alloy according to the present invention can satisfactorily exhibit their own magnetic properties due to the fact that the major phase is formed by the substantially tetragonal crystals of the FeBR type. The FeCoBR type alloy is characterized by its high Curie point, and it has further been experimentally ascertained that the presence of the substantially tetragonal crystals of the FeCoBR (or (Fe,Co)-B-R) type contributes to the exhibition of magnetic properties and, particularly, its contribution to the magnetic properties of the FeCoBR base tetragonal system alloy is unknown in the art, and serves to provide a vital guiding principle for the production of magnetic materials and permanent magnets having high magnetic properties as aimed at in the present invention.

The tetragonal system of the FeCoBR type alloys according to the present invention has lattice constants of Ao: about 8.8Å and Co: about 12.2 Å. It is useful where this tetragonal system compound constitutes the major phase of the FeCoBR type magnets, i.e., it should occupy 50 vol % or more of the crystal structure in order to yield practical and good magnetic properties.

Besides the suitable mean crystal grain size of the FeCoBR base alloys, as discussed hereinabove, the presence of a rare-earth (R) rich phase (i.e., includes about 50 at % of R) serves to yield good magnetic properties, e.g., the presence of 1 vol % or more of such R-rich phase is very effective.

The FeCoBR tetragonal system compounds are present in a wide compositional range, and may be present in a stable state also upon addition of certain elements other than R, Fe and B. The magnetically effective tetragonal system may be "substantially tetragonal" which term comprises ones that have a slightly deflected angle between a, b and c axes, i.e., within about 1 degree, or ones that have Ao slightly different from bo, i.e., within about 1%. The same is applied to the FeCoBRM system.

The aforesaid fundamental tetragonal system compounds are stable and provide good permanent magnets, even when they contain up to 1% of H, Li, Na, K, Be, Sr, Ba, Ag, Zn, N, P, Se, Te, Pb or the like.

As mentioned above, the FeCoBR type tetragonal system compounds are new ones whose contribution to the magnetic properties have been entirely unknown in the art. It is thus new fact that high properties suitable for permanent magnets are obtained by forming the major phases with these new compounds.

In the field of RFe alloys, it has been reported to prepare ribbon magnets by melt-quenching. However, the invented magnets are different from the ribbon magnets in the following several points. That is to say, the ribbon magnets can exhibit permanent magnet properties in a transition stage from the amorphous or metastable crystal phase to the stable crystal state. Reportedly, the ribbon magnets can exhibit high coercive force only if the amorphous state still remains, or otherwise metastable $Fe_3B$ and $R_6Fe_{23}$ are present as the major phases. The invented magnets have no signs of any alloy phase remaining in the amorphous state, and the major phases thereof are not $Fe_3B$ and $R_6Fe_{23}$.

The preferred embodiments of the present invention will now be explained in further detail with reference to the examples illustrated in the accompanying drawings, but are not intended to limit the present invention.

DETAILED DESCRIPTION OF THE PREFERRED EMBODIMENTS GENERAL AND FIRST ASPECT

An essential role Co plays in the isotropic permanent magnets of the present invention is to improve the temperature dependence of magnetic properties by increasing Curie points.

50 atomic % or more of Co is incorporated in the alloy composition substituting for Fe, whereby the temperature dependence thereof is improved further to a practical level. The amount of Co is small compared with the SmCo base magnets (containing 50–60 weight % of Co), and higher magnetic properties are obtained using as the rare-earth element R relatively abundant light rare earth elements such as neodymium Nd and praseodymium Pr. Thus, the present invention offers advantages over the conventional RCo magnets (substantially limited to SmCo) in view of both resources and prices, and provides permanent magnets which are further improved with respect to the magnetic properties thereof.

Figure 1:
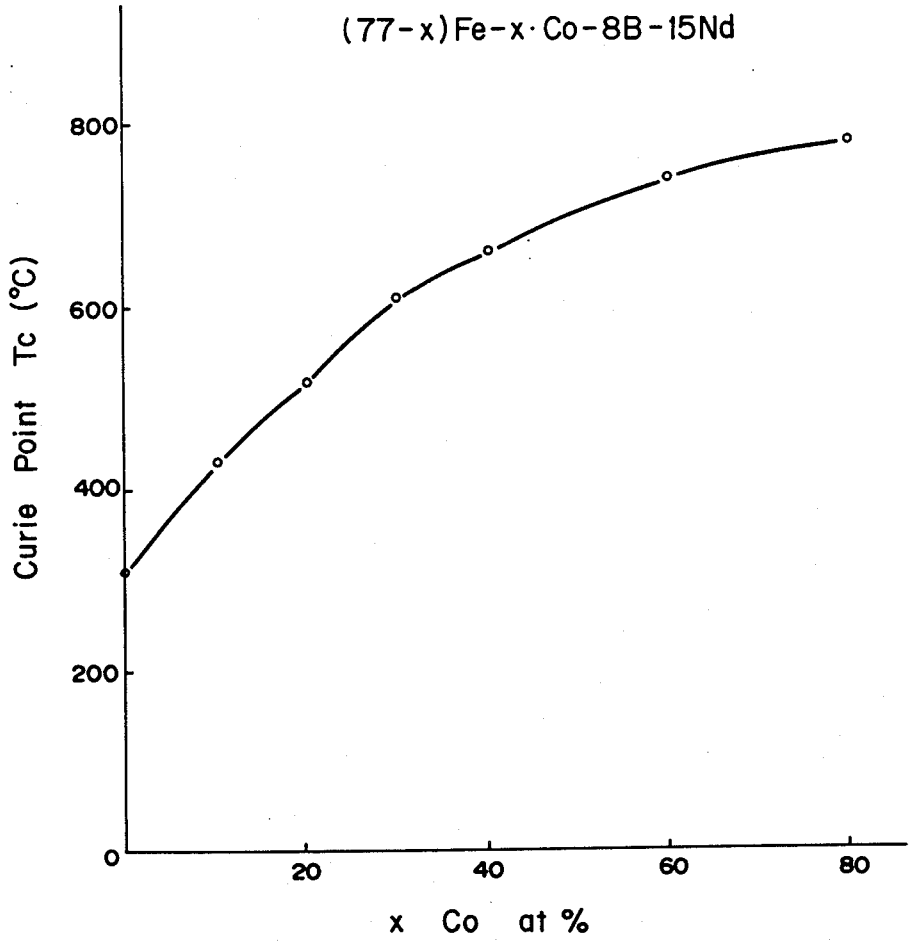
FIG. 1 is a graph showing the relationship between the Curie point (Tc) and the amount of Co in one example of the present invention (with the atomic percent of Co on abscissa)
Figure 5:
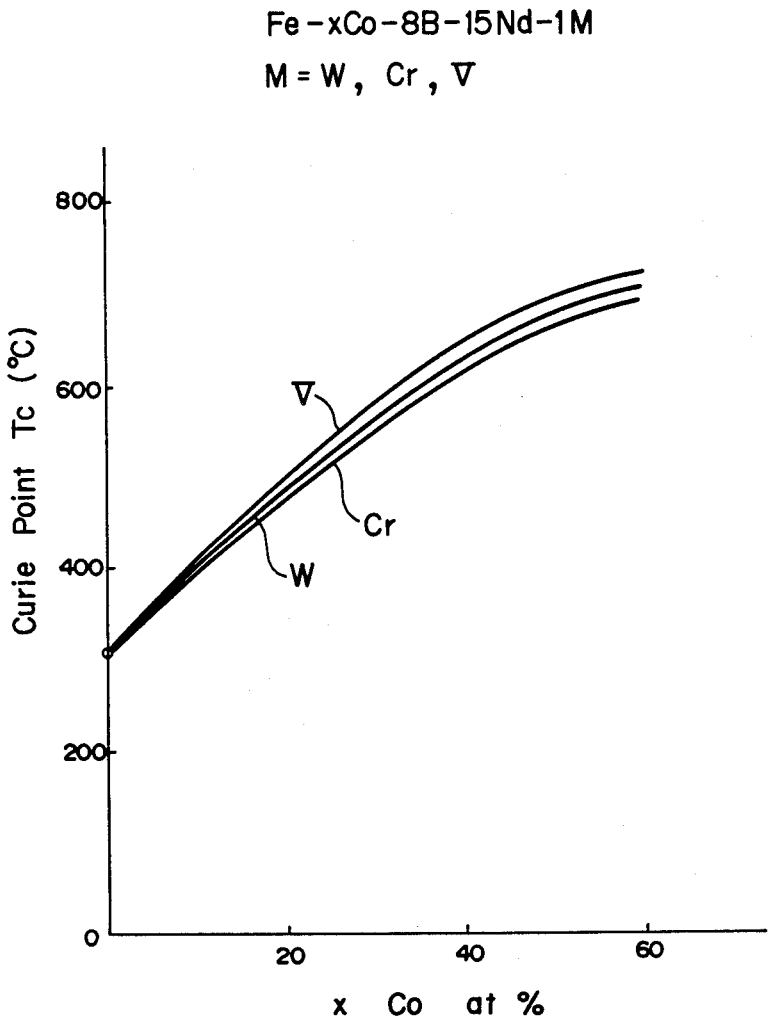
FIG. 5 is a graph showing the relationship between the amount of Co (abscissa) and the Curie point (ordinate) in an example of the permanent magnets of the present invention.

It is generally appreciated that some Fe alloys increase in Curie points (Tc) with increases in the amount of Co to be added, whereas another decreases. For that reason, the substitution of Fe with Co gives rise to complicated results which are very difficult to be anticipated. In the substitution of Fe with Co according to the present invention, it has been found that Tc increases gradually with increases in the amount of Co, as shown in FIGS. 1 and 5. In the present invention, similar tendencies in respect of Tc are ascertained regardless of the type of R. Only a slight amount, e.g., 0.1 to 1%, of Co is effective in increasing Tc. As will be evident from FIG. 1 which exemplifies (77-x)FexCo8B15Nd systems and FIG. 5 which exemplifies (76-x)FexCo8B15Nd1M systems, it is possible to obtain alloys having any Tc between about 300 degrees C. and about 700 degrees C. by the adjustment of the amount of Co.

In the Co-substituted FeBR base permanent magnets (FeCoBR systems), the combined composition of F, R, and (Fe+Co) is basically identical with that of the Co-free FeBR base alloys.

Both the FeCoBRM and FeCoBRMA systems of the present invention are based on the FeCoBR system, and are similarly determined in respect of the ranges of B and R.

To meet a coercive force iHc of no less than 1 kOe, the amount of B should be no less than 3 atomic % (hereinafter "%" will denote the atomic percent in the alloys) in the present invention. An increase in the amount of B increases iHc but decreases Br (see FIGS. 4 and 12). Hence, the amount of B should be no more than 23% to obtain (BH)max of no less than 2 MGOe, since Br of at least 3 kG is required to this end.

Figure 3:
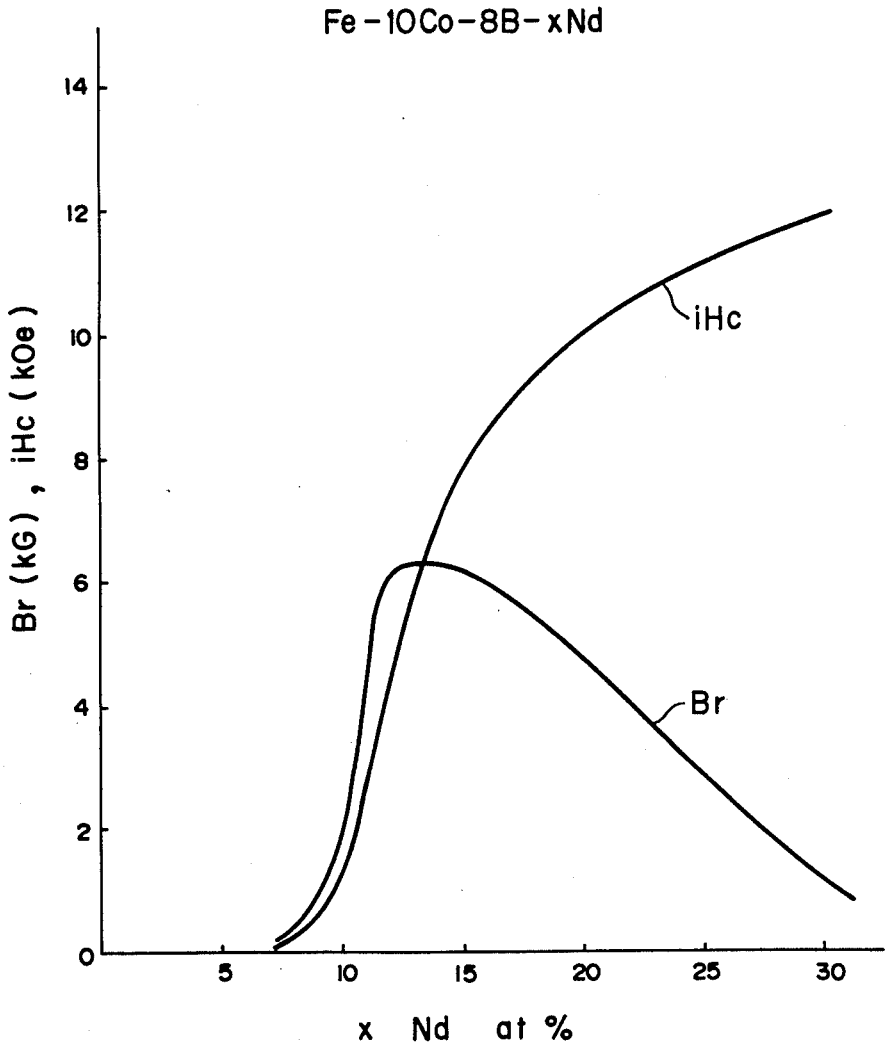
FIG. 3 is a graph showing the relationship between the amount of R (Nd by atomic % on abscissa) and Br (kG) as well as iHc (kOe)
Figure 13:
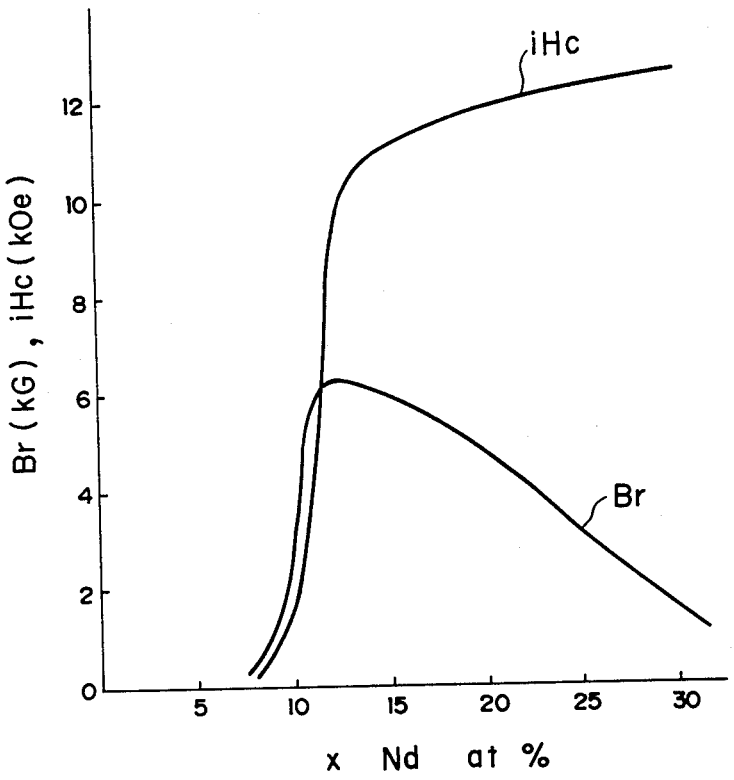

FIGS. 3 and 13 (M=W) are illustrative of the relationship between the amount of R and iHc as well as Br in the FeCoBR base permanent magnets. As the amount of R increases, iHc increases, but Br increases up to a peak then decreases. Hence, the amount of R should be no less than 10% to obtain (BH)max of no less than 2 MGOe, and should be no more than 25% for similar reasons and due to that fact that R is expensive, and so easy to burn that difficulties are involved in technical handling and production.

Figure 4:
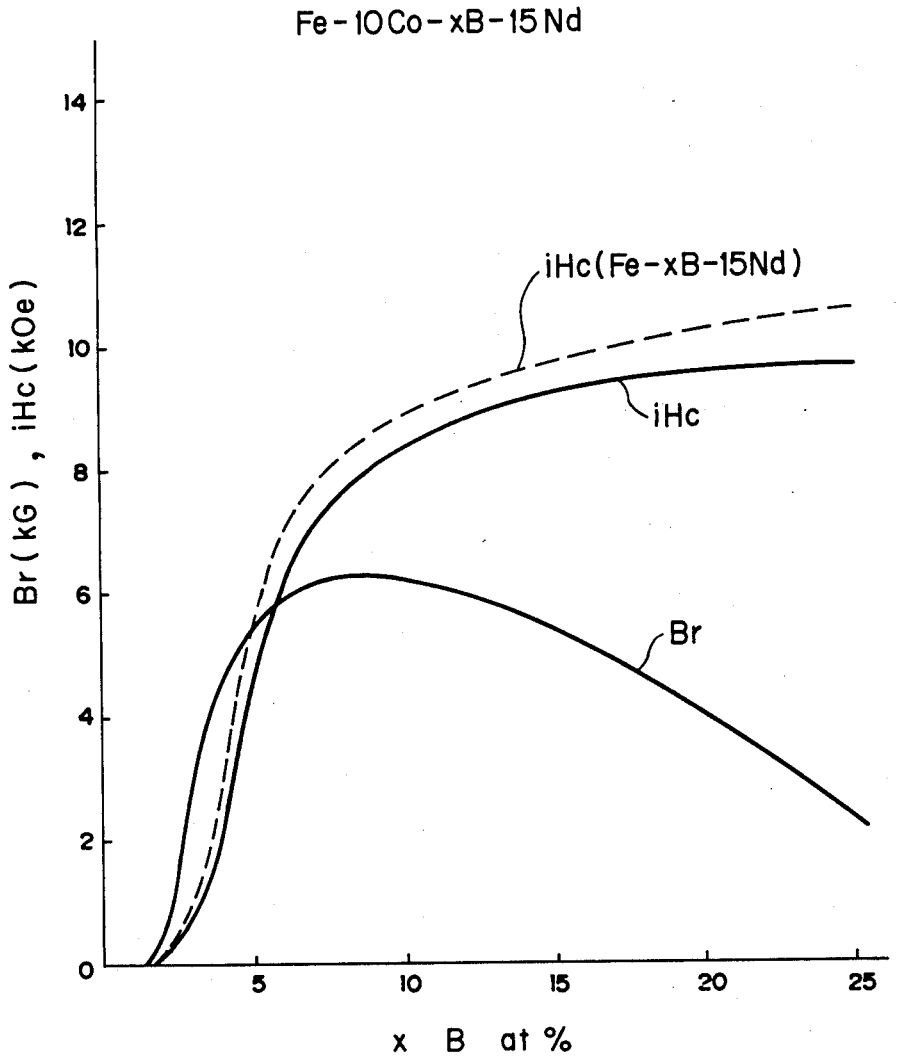
FIG. 4 is a graph showing the relationship between the amount of B and Br (kG) as well as iHc (kOe) (atomic % on abscissa)

Consisting essentially of, in atomic %, 10–25% R, 3–23% of B, 50% or less of Co and the balance being Fe, as mentioned above, the FeCoBR base permanent magnets show a coercive force iHc of no less than 1 kOe, a residual magnetic flux density Br of no less than 3 kG and a maximum energy product (BH)max of no less than 2 MGOe (see FIGS. 3 and 4). The same also holds for the FeCoBRM systems within the prescribed range of M.

Preferable are the FeCOBR compositions in which R is 12–20% with the main component being light rare earth elements such as Nd or Pr (the light rare earth elements amounting to 50% or higher of the overall R), B is 5–18%, Co is no more than 25%, and the balance is Fe, since it is then possible to achive high magnetic properties represented by (BH)max of no less than 4 MGOe. As to FeCoBRM systems the same is applied for R, B, Co and Fe provided M is within a prescribed preferred range.

Most preferable are the FeCoBR compositions in which R is 12–16% with the main component being light rare earth such as Nd or Pr, B is 6–18%, Co is no more than 15%, and the balance being Fe, since it is then possible to achive high properties represented by (BH)max of no less than 5 MGOe, which has never been obtained in the conventional isotropic permanent magnets. As to FeCoBRM systems the same is applied for R, B, Co and Fe provided that M is within a prescribed most preferred range.

The present invention is very useful, since the raw materials are inexpensive owing to the fact that relatively abundant rare earth elements can be used as R, and that Sm is not necessarily used, and is not used as the main ingredient.

Besides, Y, R used in the permanent magnets of the present invention include light- and heavy-rare earth, and at least one thereof may be used. That is, use may be made of Nd, Pr, lanthanum La, cerium Ce, terbium Te, dysprosium Dy, holmium Ho, erbium Er, europium Eu, samarium Sm, gadolinium Gd, promethine Pm, thulium Tm, ytterbium Yb, lutetium Lu, Y and the like. It suffices to use light rare earth (e.g., no less than 50%) as R, and particular preference is given to Nd and Pr, e.g., to use no less than 50% of (Nd+Pr). Usually, it suffices to use one element as R, but, practically, use may be made of mixtures of two or more elements such as mischmetal, dydimium, etc. due to easiness in availability. Sm, La, Ce, Gd, Y, etc. may be used in the form of mixtures with light rare earth such as Nd and Pr. R may not be pure light rare-earth elements, and contain inevitable impurities entrained from the process of production (other rare-earth elements, Ca, Mg, Fe, Ti, C, O, etc.), as long as such R is industrially available.

The starting B may be pure boron or alloys of B with other constitutional elements such as ferroboron, and may contain as impurities Al, C, silicon Si and the like. The same holds for all the aspects of the present invention.

THIRD ASPECT

The FeBR base permanent magnets disclosed in the prior application are obtained as magnetically anisotropic sintered bodies, and the permanent magnets of the present invention are obtained as similar sintered bodies, except that they are isotropic. In other words, the isotropic permanent magnets of the present invention are obtained by preparing alloys, e.g., by melting and cooling (e.g., casting) and pulverizing, compacting under pressure and sintering the alloys. Melting may be carried out in vacuo or in an inert gas atmosphere, and cooling may be effected by, e.g., casting. For casting, a mold formed of copper or other metals may be used. In the present invention, it is desired that a water-cooled type mold is used with the application of a rapid cooling rate to prevent segregation of the ingredients of ingot alloys. After sufficient cooling, the alloys are coarsely pulverized in a stamp mill or like means and, then, finely pulverized in an attritor, ball mill or like means to no more than about 400 microns, preferably 1–100 microns.

In addition to the aforesaid pulverization procedure mechanical pulverization means such as spraying and physiochemical pulverization means such as reducing or electrolytic means may be relied upon for the pulverization of the FeCoBR base alloys. The starting alloys of the present invention may be obtained by the so-called direct reduction process in which the oxides of rare earth are directly reduced in the presence of other constitutional elements (Fe and B or an alloy thereof) with the use of a reducing agent such as Ca, Mg or the like, resulting in powders.

The finely pulverized alloys are formulated into a given composition. In this case, the FeCoBR base or mother alloys may partly be added with other constitutional elements or alloys thereof for the purpose of adjusting the composition. The alloy powders formulated at the given composition are compacted under pressure in the conventional manner, and the compacted mass is sintered at a temperature of about 900–1200 degrees C., preferably 1050–1150 degrees C. for a given period of time. It is possible to obtain the isotropic sintered magnet bodies having high magnetic properties by selecting the sintering conditions (especially temperature and time) in such a manner that the mean crystal grain size of the sintered bodies comes within the predetermined range after sintering. For instance, sintered bodies having a preferable mean crystal grain size can be obtained by compacting the starting alloy powders having a particle size of no more than 100 microns, followed by sintering at 1050–1150 degrees C. for 30 minutes to 8 hours.

The sintering is preferably carried out in vacuo or at a reduced pressure, e.g., at $10^{-2}$ Torr or below, or in an inert gas atmosphere, e.g., of 99.9% purity or higher at 1–760 Torr. During compacting, use may be made of bonding agents such as camphor, paraffin, resins, ammonium chloride or the like and lubricants or compacting-aids such as zinc stearate, calcium stearate, paraffin, resins or the like.

Compared with the Co-free FeBR ternary system magnets, the Co-containing FeBR magnets of the present invention have low temperature dependence, and exhibit substantially similar Br and equal or slightly lower iHc, but they have equal or larger (BH)max, since improvements are introduced into loop squareness.

Co is more anti-corrosive than Fe and, hence, it is possible to increase the corrosion resistance of the FeBR alloys by incorporating Co therein.

EXAMPLES (1st–3rd Aspects)

FIG. 1 shows changes in Curie points Tc of typical (77-x)FexCo8B15Nd obtained by the substitution of a part of Fe of 77Fe8B15Nd with Co(x) wherein x varied between 0 and 77. The samples were prepared by the following steps.

(1) Alloys were prepared by high-frequency melting, and cast in a water-cooled copper mold. The starting Fe was electrolytic iron of 99.9% purity, the starting B was a ferroboron alloy containing 19.4% of B with the balance being Fe and impurities Al, Si and C, the starting R had a purity of 99.7% or higher (impurities being mainly other rare-earth metals), and the starting Co was electrolytic Co of 99.9% purity.

(2) Crushing was effected to 35-mesh through in a pulverizing stamp mill and fine pulverization was carried out for 3 hours in a ball mill (3–10 microns).

(3) Compacting was carried at a pressure of 1.5 t/cm$^2$.

(4) Sintering was carried out at 1000–1200 degrees C. for 1 hour in an argon flow in such a manner that the crystal grain sizes of the sintered bodies came within a 5–30 micron range, followed by allowing to cool. Blocks weighing about 0.1 gram were cut out of the sintered bodies, and their Curie points Tc were measured with a VSM in the following manner. A 10 kOe magnetic field was impressed on the samples to measure the changes in $4\pi I$ due to temperature in a temperature range of 25–600 degrees C. The Curie points Tc were expressed in terms of the temperature at which $4\pi I$ reduced substantially to zero.

As will be evident from FIG. 1, Tc increases sharply with increases in the amount of Co relative to Fe, and reaches 600 degrees C. or higher, when the amount of Co exceeds 30%. In the permanent magnet materials, the increase in Tc is generally an important factor for reducing variations in the magnetic properties due to temperature. To ascertain this point, the permanent magnet materials are shown in Table 1 were prepared in the same steps as applied to prepare those for measuring Tc, and measured on their temperature dependence.

The changes in Br due to temperature were measured in the following manner. That is to say, the magnetization curves of the samples were obtained at temperatures 25 degrees C., 60 degrees C. and 100 degrees C., and the changes in Br due to temperature were averaged between 25 degrees C. and 60 degrees C., and between 60 degrees C. and 100 degrees C.

Table 1 shows the results of the temperature coefficients of Br and the magnetic properties of various FeCoBR base magnet samples and the comparative samples.

From Table 1, it is evident that improvements are introduced into the temperature dependence of Br by the incorporation of Co into the FeBR base magnets.

To examine the relationship between the amounts of R and B and iHc as well as Br, samples based on Fe10Co8BxNd systems wherein x varied between 0 and 30 and Fe10CoxB15Nd systems wherein x varied between 0 and 30 were prepared in the same manner as mentioned above to measure the magnetic properties thereof. The results are set forth in FIGS. 3 and 4. FIG. 4 also shows the iHc curves of Co-free, FexB15Nd systems, which are obtained in a similar manner.

Although the coercive force iHc slightly decreases due to the substitution by Co, the maximum energy product (BH)max increases due to the improvement in the loop squareness of the demagnetization curve. As the Co amount increase up to around 50% iHc largely decreases. Thus Co should be no more than 50% so as to ensure iHc of at least 1 kOe (see: Table 1, No. C4).

In Table 1 examples using mainly Nd or Pr as R, both exhibiting high magnetic properties accompanied with the improvement in the temperature dependence due to substitution for Fe. As R, also mixtures of two or more rare earth elements are useful. The temperature coefficient of Br becomes about 0.1%/°C. or less at 5% or higher Co. In consideration of Br and iHc, 25% or less Co is preferable and particularly 15% or less Co is most preferred. Co is effective even in a small amount of, e.g., 0.1%.

TABLE 1

| No. | compositions (at %) | temperature coefficient of Br (%/°C.) | magnetic properties iHc (kOe) | Br(kG) | (BH)max (MGOe) |
|---|---|---|---|---|---|
| C1 | Fe—8B—15Nd | 0.14 | 8.5 | 6.4 | 8.7 |
| C2 | Fe—30Co—15Nd | — | <1 | <1 | <1 |
| C3 | Fe—17B—30Nd—10Co | 0.11 | 10.5 | 2.0 | <1 |
| C4 | Fe—60Co—10B—15Nd | 0.05 | 0.6 | 3.8 | 1.2 |
| C5 | Fe—40Co—30B—15Nd | 0.08 | 5.0 | 1.2 | <1 |
| C6 | Fe—16B—7Pr—20Co | — | <1 | <1 | <1 |

TABLE 1-continued

| No. | compositions (at %) | temperature coefficient of Br (%/°C.) | magnetic properties iHc (kOe) | Br(kG) | (BH)max (MGOe) |
|---|---|---|---|---|---|
| 7 | Fe—10Co—8B—15Nd | 0.09 | 7.8 | 6.3 | 7.5 |
| 8 | Fe—20Co—8B—15Nd | 0.08 | 7.3 | 5.6 | 5.8 |
| 9 | Fe—30Co—8B—15Nd | 0.06 | 6.5 | 4.9 | 4.7 |
| 10 | Fe—40Co—8B—15Nd | 0.06 | 2.8 | 5.3 | 3.4 |
| 11 | Fe—50Co—12B—15Nd | 0.05 | 1.8 | 4.1 | 2.2 |
| 12 | Fe—15Co—15B—10Nd—5Pr | 0.09 | 6.8 | 3.9 | 3.0 |
| 13 | Fe—10Co—10B—5Dy—11Pr | 0.09 | 7.2 | 4.2 | 3.5 |
| 14 | Fe—20Co—8B—5Nd—10Ho | 0.08 | 7.0 | 3.2 | 2.0 |
| 15 | Fe—10Co—15B—10Nd—5Ho—2La | 0.09 | 6.7 | 3.7 | 2.7 |
| 16 | Fe—20Co—8B—10Pr—8Nd | 0.08 | 7.8 | 5.4 | 5.7 |
| 17 | Fe—50Co—8B—15Pr | 0.05 | 2.8 | 5.3 | 3.6 |

Like the ferrite or RCo magnets, the isotropic permanent magnets of the FeCoBR base sintered bodies are the single domain, fine particle type magnets, which give rise to unpreferable magnet properties without being subjected to, once pulverizing, compacting under pressure and sintering.

With the single domain, fine particle type magnets, no mgnetic walls are present within the fine particles, so that the inversion of magnetization is effected only by rotation, which contributes to further increases in coercive force.

Figure 2:
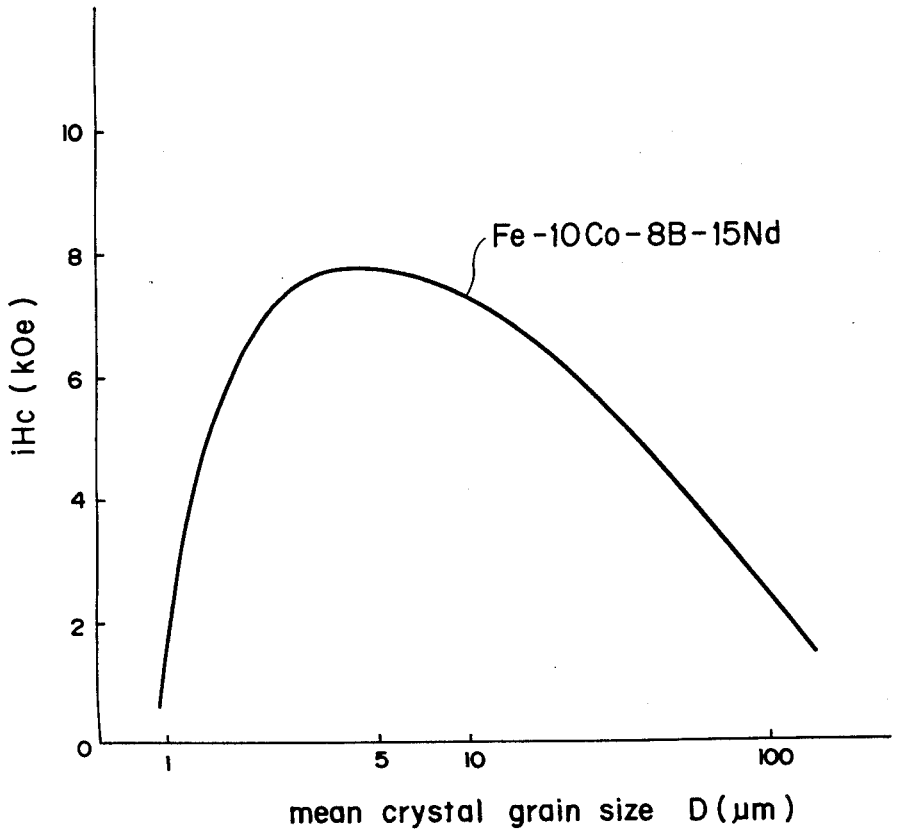
FIG. 2 is a graph showing the relationship between the coercive force iHc (kOe) and the mean crystal grain size in one example of the present invention (with the mean crystal grain size D (microns) on abscissa)

The relationship was investigated between the mean crystal grain size and iHc of one example (Table 1, sample No. 7) of the FeCoBR base isotropic permanent magnets of the present invention. The results are shown in FIG. 2, from which it is found that the mean crystal grain size after sintering should be within a range of about 1 to about 130 mirons to achieve iHc of no less than 1 kOe. A preferable range is 1–80 microns, and a more preferable range is 3–30 microns.

The magnets of the present invention may be prepared using granulated powders (on the order of several tens to several hundreds microns) in which binders and lubricants are added to the alloy powders. The binders and lubricants are not usually employed for the forming of anisotropic magnets, since they disturb orientation. However, they can be incorporated into the compacts of the present invention, since the present magnets are isotropic. Furthermore, the incorporation of such agents would possibly results in improvements in the efficiency of compacting the strength of the compacted bodies.

As stated in detail in the foregoing, the FeCoBR base isotropic permanent magnets according to the 1st–3rd aspects can exhibit high magnetic properties through the use of, as R, inexpensive raw materials such as light rare earth, particularly light- and heavy-rare earth mixtures, for instance, mischmetal or dydimium, and can sufficiently save Co, since they contain at most 45 weight % (or 50 atomic %) of Co, compared with the SmCo base magnets containing 50–60 weight % of Co. The present magnets have also their temperature dependence improved markedly over that of the FeBR base magnets to such an extent that they can satisfactorily be put to wide practical use.

In addition to Fe, Co, B and R, the permanent magnets of the present invention permit the presence of impurities as hereinbelow deslosed as the Seventh Aspect.

FOURTH ASPECT (FeCoBRM Systems)

According to the fourth aspect of the present invention, additional elements M are added to the FeCoBR base alloys, whereby improvements can be introduced in coercive force iHc. As M use may be made of at least one of Al, Ti, V, Cr, Mn, Zr, Hf, Nb, Ta, Mo, Ge, Sb, Sn, Bi, Ni and W. In general, the coercive force iHc drops with increases in temperature. However, it is possible to increase iHc at normal temperature by the addition of M, so that no demagnetization would take place upon exposure to elevated temperatures. As the amount of M increases, however, there is a lowering of Br and, hence, (BH)max, for M is (are) a nonmagnetic element(s) (save Ni). The M-containing alloys are very useful in recently increasing applications where higher iHc is needed at the price of slightly reduced (BH)max, on condition that (BH)max is no less than 2 MGOe.

It is preferred to make Br no less than 3 kG so as to make (BH)max equivalent to, or greater than, about 2 MGOe which is the level of hard ferrite. To this end, as shown in FIGS. 6 to 9, the upper limits of M are defined at the following values:

| | | | |
|---|---|---|---|
| 8.7% Al, | 4.3% Ti, | 8.7% V, | 8.3% Cr, |
| 8.0% Mn, | 5.5% Zr, | 5.0% Hf, | 12.4% Nb, |
| 10.3% Ta, | 8.7% Mo, | 5.7% Ge, | 2.4% Sb, |
| 3.5% Sn, | 4.8% Bi, | 4.3% Ni, | 8.8% W. |

When two or more elements M are added, the resulting properties appear by way of the synthesis of the properties of the individual elements, which varies depending upon the proportion thereof. In this case, the amounts of the individual elements M are within the aforesaid limits, and the combined amount thereof is no more than the maximum value of the upper limits of the elements which are actually added. It is noted that, when the elements A are further contained, the same holds for the combined amount of (M+A).

The addition of M incurs a gradual lowering of residual magnetization Br. Hence, according to the present invention, the amount of M is determined such that the obtained magnets have a Br value equal to, or greater than, that of the conventional hard ferrite magnets and a coercive force equal to, or greater than, that of the conventional products.

Figure 12:
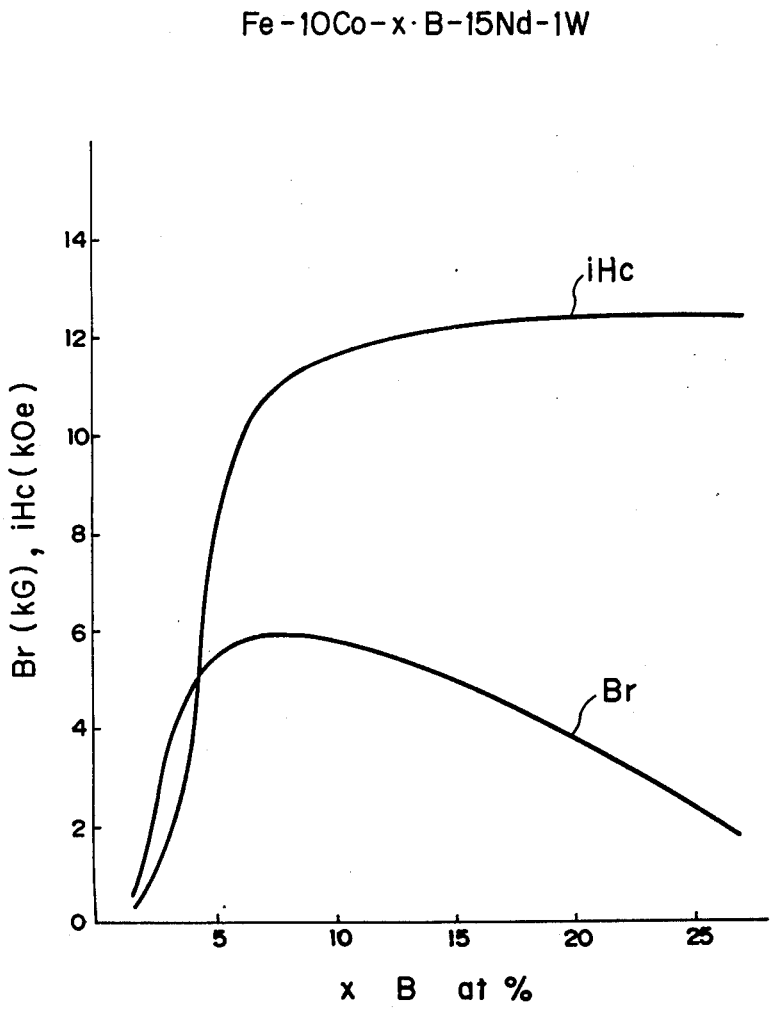
FIGS. 12 and 13 are graphs showing the relationship between the amounts B and R and iHc and Br, respectively.

Fundamentally, the addition of M has an effect upon the increase in coercive force iHc, which, in turn, increases the stability and, hence, the use of magnets. It is particularly effective to the energy product that due to minor incorporation of M iHc steeply rises within a peak range of Br as B increases as shown in FIG. 12 in contrast to FIG. 4. The amount of M is preferably determined depending upon the level of any given Br, e.g., 4, 5, 5.8, 6 kG or higher.

With the increases in iHc, the lowering of Br and the influence upon (BH)max in mind, the amount of M to be added is most preferably in a range of 0.1 to 3.0% in order to obtain Br of at least 5.8 kG, provided that the most preferable upper limits of the individual elements M are as follows:

| | | |
|---|---|---|
| 2.0% Al, | 1.0% Ti, | 2.0% V, |
| 1.4% Cr, | 1.7% Mn, | 1.1% Zr, |
| 0.9% Hf, | 1.7% Nb, | 1.7% Ta, |
| 2.2% Mo, | 1.3% Ge, | 0.3% Sb, |
| 0.5% Sn, | 0.7% Bi, | 1.0% Ni, and |
| 3.0% W. | | |

Within this range of M an energy product (BH)mx of 5 or 6 MgOe or higher is obtained depending upon the amount of Co.

The preferable amount of M to make Br equal to, or greater than, 4 kG are fixed at or below the following values by atomic %:

| | | |
|---|---|---|
| 7.3% Al, | 3.6% Ti, | 7.3% V, |
| 6.8% Cr, | 6.6% Mn, | 4.4% Zr, |
| 4.2% Hf, | 9.5% Nb, | 8.2% Ta, |
| 7.5% Mo, | 4.7% Ge, | 1.9% Sb, |
| 3.0% Sn, | 3.8% Bi, | 3.6% Ni, |
| 7.9% W. | | |

However, when two or more elements M are added, the combined amount of M is no more than the maximum value of the respective upper limits of the elements which are actually added.

Preferably M is V, Nb, Ta, Mo, W, Cr, and Al, and particular reference is given to a small amount of Al.

FIFTH ASPECT (CRYSTAL GRAIN SIZE)

Figure 10:
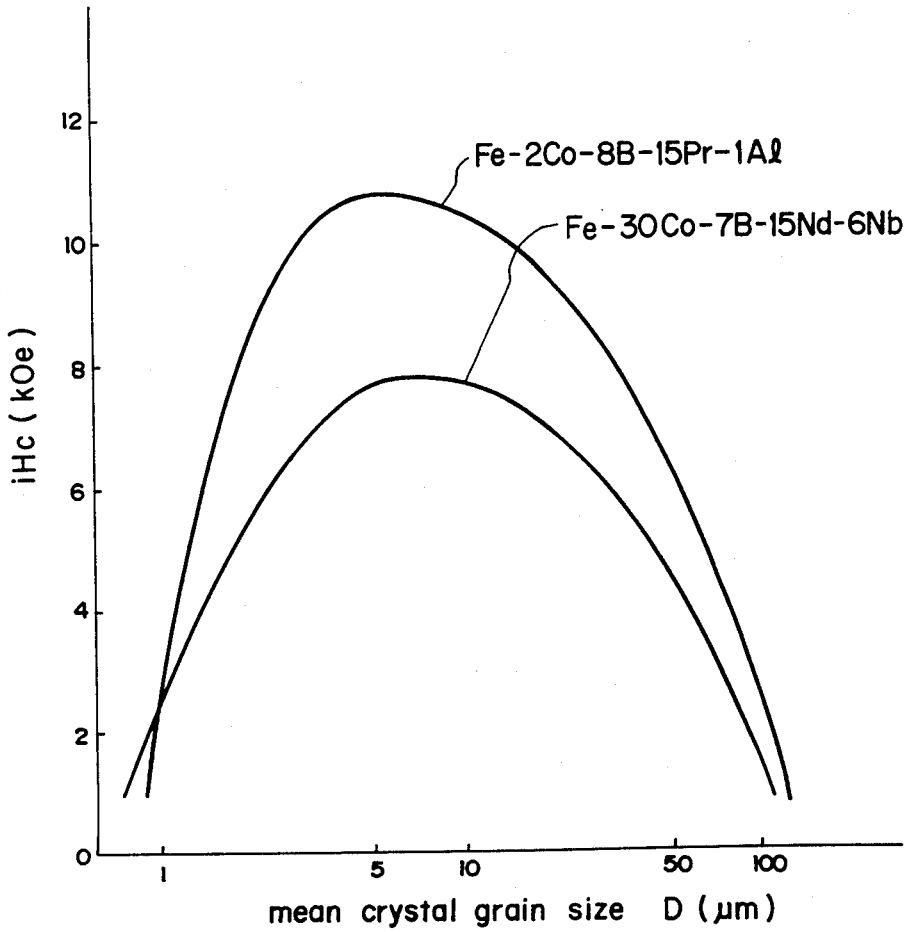
FIG. 10 is a graph showing the relationship between the mean crystal grain size (abscissa) and the coercive force iHc in an example of the present invention.

As shown in FIG. 10, the FeCoBRM base magnets give iHc of no less than 1 kOe, when the mean crystal grain size of the sintered bodies ranges from 1 to 100 microns. In ranges of 2 to 40 microns and 3 to 15 microns, preferable and more preferably iHc is obtained, respectively.

SIXTH ASPECT (MANUFACTURING PROCESS)

The process for the production of the FeCoBRM base magnets are basically identical with that for the FeCoBR systems, with the exception of adding M. However, the starting materials may be alloys of the respective constitutional elements.

The alloy powders to be compacted may be the FeCoBRM alloys which have been molten and pulverized. Alternatively, it is possible to prepare the starting alloy powders by adding Co and/or M elements (or alloys thereof) in the FeBR or FeCoBR base alloys.

SEVENTH ASPECT

In accordance with the seventh aspect of the present invention, the FeCoBR and FeCoBRM systems may contain given percents or less of the elements A including Cu, S, C, P, Ca, Mg, O, Si and the like. When the FeCoBR or FeCoBRM base magnets are industrially produced, these elements may often be entrained thereinto from the raw materials, the process of production and the like. In most cases, C remains in the form of residues of organic binders (compacting-aids) used in the powder metallurgical process. Cu may often be contained in cheap raw materials. Ca and Mg tend to be entrained from reducing agents. It has been ascertained that as the amount of A to be entrained increases, the residual magnetic flux density Br tends to drop.

Figure 11:
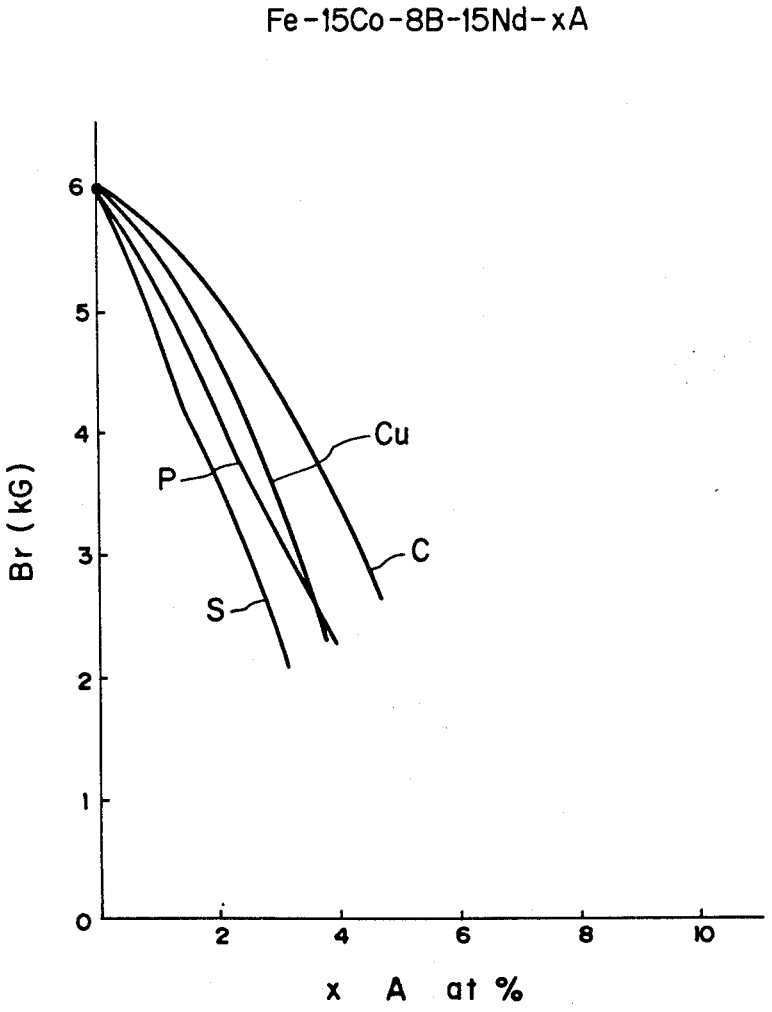
FIG. 11 is a graph showing the relationship between the amount of the element A and Br(kG)

As a result, magnetic properties equal to, or greater than, those of hard ferrite are obtained (Br or 3 kG or higher), when the amount of S, C, P and Cu, to be entrained are no more than 2.5%, 4.0%, 3.3% and 3.3%, respectively (See FIG. 11). Likewise, the entrainment of no more than 2% O, no more than 4.0% Ca, no more than 4.0% Mg and no more than 5.0% Si is admitted.

When two or more elements A are entrained, the resulting properties generally appear through the synthesis of the properties of the individual properties, and the combined amount thereof is no more than the maximum value of the upper limits of the elements actually entrained. Within such a range, Br is equal to, or greater than, that of hard ferrite.

In the case of the FeCoBRMA base isotropic permanent magnets, the combined amount of (M+A) is no more than the maximum value of the upper limits of the elements which actually added and entrained, as is substantially also the case with two or more M or A. This is because both M and A are apt to decrease Br. In the case of the addition of two or more M and the entrainment of two or more A, the resulting Br property generally appears through the synthesis of the Br properties of the individual elements, varying depending upon the proportion thereof.

Al may be entrained from a refractory such as an alumina crucible into the alloys, but offers no disadvantage since it is useful as M. M and A have been found to have no essential influence upon Curie points Tc, as long as they are within the presently claimed ranges.

EXAMPLES (FOURTH-SEVENTH ASPECTS: FeCoBRM(A) SYSTEMS)

The embodiments according to the 4th–7th aspects of the present invention will now be explained in further detail with reference to examples, to which the present invention is not limited.

Permanent magnet samples comprising FeCoBRM and FeCoBRMA alloys containing the given elements were prepared in the substantially same manner as employed in the examples according to the 3rd aspect, provided that the following materials were used for M and A.

As M use was made of Ti, Mo, Bi, Mn, Sb, Ni, Ta, Sn and Ge each of 99.9% purity as well as W of 98% purity, Al of 99.9% purity and Hf of 95% purity. As V, Nb, Cr and Zr, use was made of ferrovanadium containing 81.2% of V, ferroniobium containing 67.6% of Nb, ferrochromium containing 61.9% of chromium and ferrozirconium containing 75.5% of Zr.

As the elements A use was made of S having a purity of 99% or higher, ferrophosphorus containing 26.7% of P, C having a purity of 99% or higher and electrolytic copper having a purity of 99.9% or higher. It is noted that the unit of purity is weight %.

The magnetic properties of the foregoing samples having a variety of compositions were investigated by measuring the iHc, Br and (BH)max thereof. Tables 2 and 3 show the permanent magnet properties iHc, Br and (BH)max of typical samples. In the tables, the balance is Fe, although not indicated numerically.

Although the alloys containing as R Nd, Pr, Gd, Ho and La are exemplified, 15 rare-earth elements (Y, Ce, Sm, Eu, Tb, Dy, Er, Tm, Yb, Lu, Nd, Pr, Gd, Ho and La) show a substantially similar tendency. However, the alloys containing Nd and Pr as the main components are much more useful than those containing scarce rare earth elements (Sm, Y, heavy rare earth) as the main ingredients, since rare earth elements ores abound relatively with Nd and Pr and, in particular, Nd does not still find any wide use.

Out of the examples of the present invention shown in Tables 2 and 3, examination was made of the relationship between the coercive force iHc and the mean crystal grain size D (microns) of No. 14 in Table 2 and No. 28 in Table 3. The results are graphically illustrated in FIG. 10. It is understood that FIG. 10 is based on the samples obtained in the substantially same manner as already mentioned, on the condition that the mean crystal grain size of the sintered bodies varied.

From this, it is concluded that the predetermined grading of mean crystal grain sizes is preferable to take full advantage of the permanent magnets of the present invention.

Figure 6:
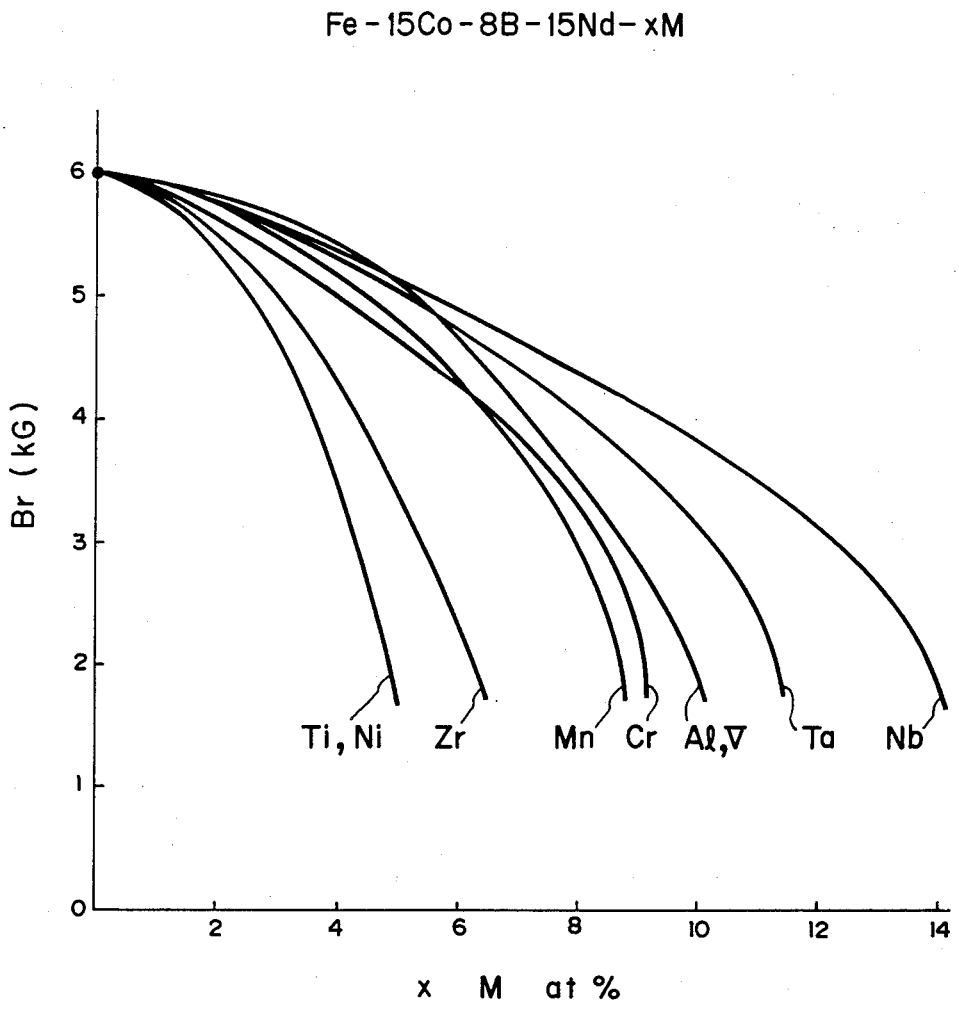
FIGS. 6 to 9 inclusive are graphs showing the relationship between the amount of the additional elements M (abscissa) and the residual magnetic flux density Br (kG) in examples of the present invention.
Figure 7:
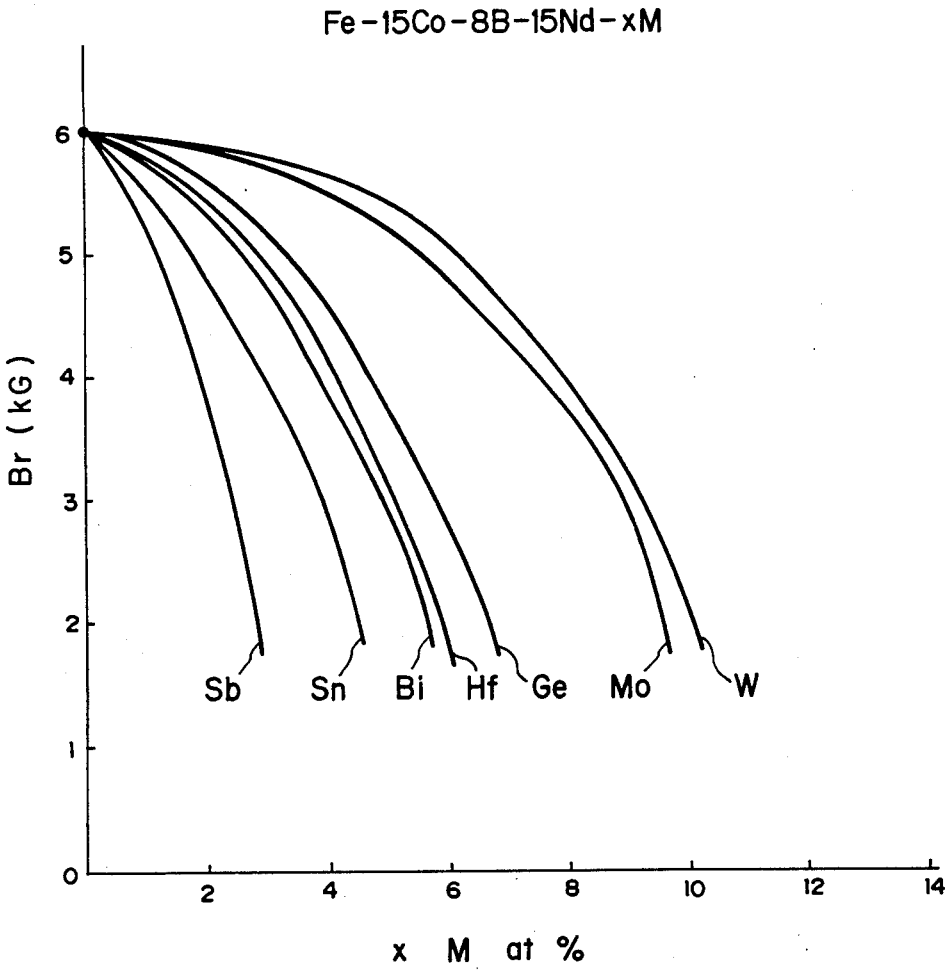

FIGS. 6 and 7 are based on the samples comprising Fe15Co8B15NdxM wherein x varies between 0 and 15 atomic %, which were prepared in the same manner as stated in the foregoing.

Figure 8:
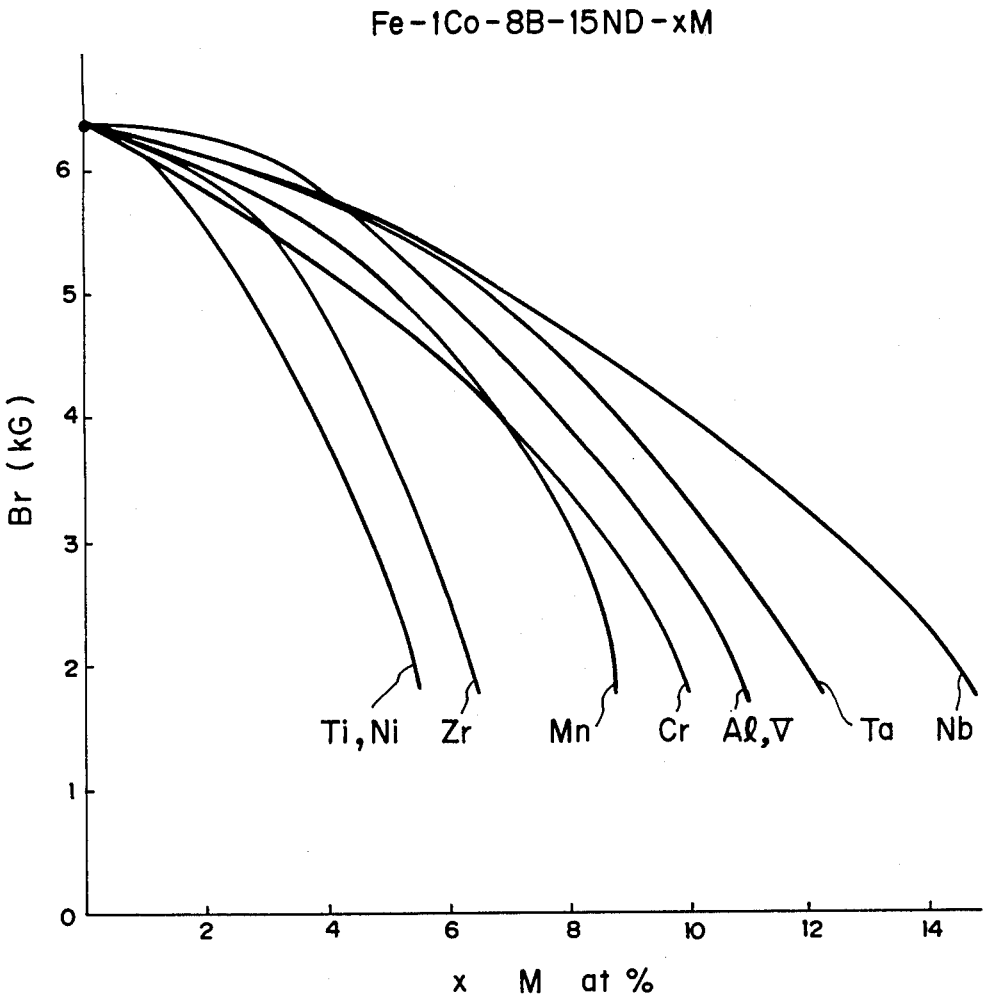
Figure 9:
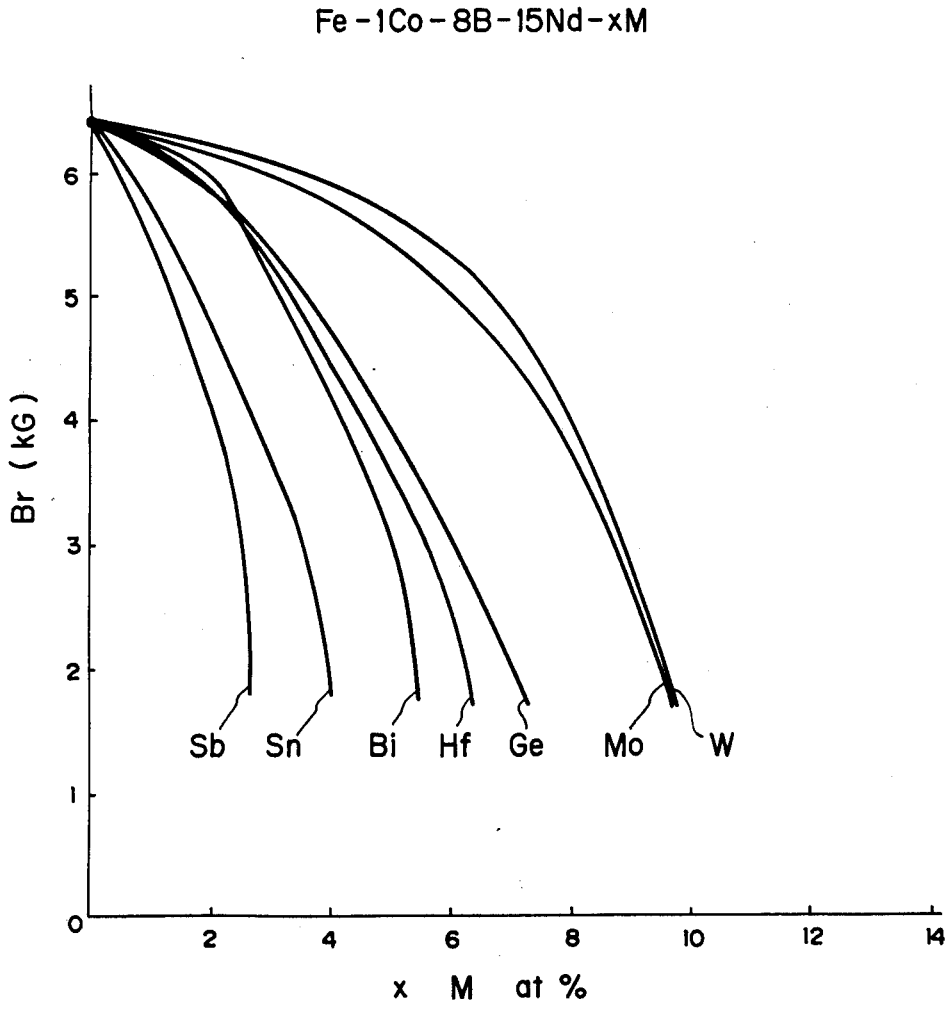

FIGS. 8 and 9 are based on the samples comprising Fe1Co8B15NdxM wherein x varies between 0 and 15 atomic %, which were prepared in the same manner as the samples of FIGS. 8 and 9.

FIG. 11 is based on the samples comprising Fe15-Co8B15NdxA wherein x varies between 0 and 10 atomic %, which were prepared in the same manner as stated hereinbefore.

Parallel results occur for the cases containing M.

TABLE 2

| No. | compositions (at %) | magnetic properties Hc (kOe) | Br(kG) | (BH)max (MGOe) |
|---|---|---|---|---|
| 1 | Fe—5Co—8B—15Nd—2Al | 12.4 | 5.6 | 6.5 |
| 2 | Fe—20Co—8B—13Nd—0.5Al | 10.6 | 4.9 | 4.7 |
| 3 | Fe—35Co—6B—17Nd—1Ti | 8.8 | 4.6 | 4.1 |
| 4 | Fe—10Co—17B—14Nd—3Ti | 7.6 | 3.5 | 2.5 |
| 5 | Fe—2Co—10B—16Nd—3V | 9.2 | 3.2 | 2.1 |
| 6 | Fe—15Co—7B—14Nd—2Cr | 7.2 | 4.4 | 3.9 |
| 7 | Fe—25CO—7B—14Nd—1Mn | 8.8 | 5.4 | 5.7 |
| 8 | Fe—5Co—9B—15Nd—1Zr | 8.0 | 5.2 | 5.3 |
| 9 | Fe—20Co—17B—14Nd—0.5Zr | 10.1 | 3.9 | 3.1 |
| 10 | Fe—10Co—10B—15Nd—5Zr | 7.8 | 3.3 | 2.2 |
| 11 | Fe—15Co—8B—14Nd—1Hf | 11.4 | 5.5 | 6.2 |
| 12 | Fe—2Co—7B—15Nd—1Nb | 7.3 | 5.9 | 7.2 |
| 13 | Fe—10Co—8B—16Nd—3Nb | 7.3 | 4.7 | 4.5 |
| 14 | Fe—30Co—7B—15Nd—6Nb | 7.8 | 3.5 | 2.4 |

TABLE 2-continued

| No. | compositions (at %) | magnetic properties Hc (kOe) | Br(kG) | (BH)max (MGOe) |
|---|---|---|---|---|
| 15 | Fe—20Co—13B—14Nd—3Ta | 8.6 | 5.1 | 5.1 |
| 16 | Fe—3Co—8B—15Nd—1Mo | 8.6 | 6.1 | 7.7 |
| 17 | Fe—15Co—8B—15Nd—1.5Mo | 13.5 | 6.0 | 7.4 |
| 18 | Fe—25Co—6B—17Nd—5Mo | 9.4 | 5.2 | 5.1 |
| 19 | Fe—1Co—8B—15Nd—0.5W | 9.8 | 6.1 | 7.8 |
| 20 | Fe—10Co—8B—15Nd—1W | 11.2 | 5.9 | 7.1 |

TABLE 3

| No. | compositions (at %) | magnetic properties Hc(kOe) | Br(kG) | (BH)max (MGOe) |
|---|---|---|---|---|
| 21 | Fe—25Co—7B—14Nd—6W | 8.2 | 4.6 | 4.0 |
| 22 | Fe—10Co—10B—14Nd—2Ge | 7.6 | 5.2 | 5.2 |
| 23 | Fe—5Co—20B—14Nd—0.5Sn | 6.8 | 4.1 | 3.3 |
| 24 | Fe—20Co—8B—14Nd—1Sn | 6.6 | 3.8 | 2.6 |
| 25 | Fe—25Co—10B—12Nd—1.5Bi | 8.2 | 4.0 | 3.0 |
| 26 | Fe—15Co—9B—14Nd—3Ni | 7.6 | 4.7 | 4.4 |
| 27 | Fe—10Co—12B—16Nd—1Cu | 10.2 | 4.4 | 3.8 |
| 28 | Fe—2Co—8B—15Pr—1Al | 10.8 | 5.3 | 5.6 |
| 29 | Fe—10Co—12B—14Pr—2Cr | 9.0 | 4.2 | 3.4 |
| 30 | Fe—5Co—8B—15Nd—1Nb—0.5Mn—0.3Cu | 8.7 | 4.6 | 4.2 |
| 31 | Fe—10Co—12B—10Nd—5Pr—1Mo | 9.7 | 3.7 | 2.2 |
| 32 | Fe—5Co—8B—12Nd—3Gd—1Cr | 10.0 | 4.9 | 4.8 |
| 33 | Fe—15Co—8B—10Nd—5Mo—1Al | 9.2 | 4.6 | 4.3 |
| 34 | Fe—20Co—9B—13Nd—2La—1Nb | 7.6 | 3.9 | 3.0 |
| 35 | Fe—12Co—10B—11Nd—4Ce—1Ti | 6.8 | 4.7 | 4.2 |
| 36 | Fe—5Co—12B—15Pr—1Nb—0.5C | 7.3 | 4.9 | 4.7 |
| 37 | Fe—20Co—10B—15Nd—1W—1P | 8.9 | 5.0 | 4.8 |
| 38 | Fe—3Co—8B—13Nd—2Dy—1V—1S | 5.4 | 3.6 | 2.3 |

Not only the FeCoBRM base permanent magents of the present invention offer the same advantages as achieved in the FeCoBR systems, but also present additional advantages due to the addition of M. That is to say, the increase in coercive force contributes to the stabilization of magnetic properties. Hence, the addition of M makes it feasible to obtain permanent magnets, which are particularly very stable and show a high energy product. As is the case with the addition of Co, the addition of Ni contributes to improvements in corrosion resistance.

As described in detail, the present invention provides permanent magnets comprising magnetically isotropic sintered bodies which are base on FeCoBR and FeCoBRM system alloys and may further contain impurities A, whereby magnetic properties equal to, or greater than, those achieved in the prior art are realized particularly without recourse to rare materials in resources or expensive materials. The present invention further provides isotropic permanent magnets which have coercive forces and energy products much higher than those of the conventional magnets, and show low temperature dependence substantially comparable to those of the conventional alnico and RCo base magnets. In addition, the permanent magnets of the present invention are more practical than the conventional products in may aspects including resources, prices and magnetic properties, and thus are industrially of high value, since light rare earth elements such as Nd and Pr can be used as R.

Modifications apparent in the art may be made without departing from the gist of the present invention as disclosed and claimed.

It should be also noted that any compositional modifications of the constituents within the scope of the compositional ranges as disclosed and claimed may be done without departing from the concept of the present invention, and that such modifications comprise any desired limitation corresponding to any level of magnetic properties as disclosed.

What is claimed is:

1. A powder metallurgically sintered, isotropic permanent magnet having a mean crystal grain size of 1–80 microns and consisting essentially of, by atomic percent, 12–20 percent R wherein R is at least one element selected from the group consisting of Nd, Pr, La, Ce, Tb, Dy, Ho, Er, Eu, Sm, Gd, Pm, Tm, Yb, Lu and Y and wherein at least 50% of R consists of Nd and/or Pr, 5–18 percent B, and at least 62 percent Fe in which Fe amount Co is substituted for Fe in an amount greater than zero and not exceeding 25 percent of the magnet and at least 50 vol % of the entire magnet is occupied by a ferromagnetic compound having a an (Fe,Co)-B-R-type tetragonal crystal structure which has a higher Curie temperature than a corresponding ferromagnetic Fe-B-R base compound containing no Co, the magnet having a maximum energy product of at least 4 MGOe and an intrinsic coercivity of at least 1 kOe.

2. A powder metallurgically sintered, isotropic permanent magnet having a mean crystal grain size of 1–80 microns and consisting essentially of, by atomic percent, 12–20 percent R wherein R is at least one element selected from the group consisting of Nd, Pr, La, Ce, Tb, Dy, Ho, Er, Eu, Sm, Gd, Pm, Tm, Yb, Lu and Y and wherein at least 50% of R consists of Nd and/or Pr, 5–18 percent B, at least one additional element M selected from the group given below in the amounts not exceeding the atomic percentages specified below, wherein the sum of M does not exceed the maximum value of any one of the values specified below for M actually added and at least 62 percent Fe in which Fe amount Co is substituted for Fe in an amount greater than zero and not exceeding 25 percent on the magnet:

| | | | |
|---|---|---|---|
| 7.3% Al, | 3.6% Ti, | 7.3% V, | 6.8% Cr, |
| 6.6% Mn, | 4.4% Zr, | 4.2% Hf, | 9.5% Nb, |
| 8.2% Ta, | 7.5% Mo, | 4.7% Ge, | 1.9% Sb, |
| 3.0% Sn, | 3.8% Bi, | 3.6% Ni, | and 7.9% W, |

in which a ferromagnetic compound having a an (Fe,-Co)-B-R type tetragonal crystal structure and having a higher Curie temperature than a corresponding ferromagnetic Fe-B-R base compound containing no Co occupies at least 50 vol % of the entire magnet, said permanent magnet having a maximum energy product of at least 4 MGOe and an intrinsic coercivity of at least 1 kOe.

3. A magnet as defined in claim 1 or 2, in which Co is at least 0.1 atomic %.

4. A magnet as defined in claim 1 or 2, in which Co is at least 5 atomic %.

5. A magnet as defined in claim 1 or 2, in which Co does not exceed 15 atomic %.

6. A magnet as defined in claim 1 or 2, in which R is about 15 atomic %, and B is about 8 atomic %.

7. A magnet as defined in claim 1 or 2, in which Si is present in an amount not exceeding 5 atomic %.

8. A magnet as defined in claim 1, in which the sintered magnet has a mean crystal grain size of 3–30 microns.

9. A magnet as defined in claim 2, in which the sintered magnet has a mean crystal grain size of 2–40 microns.

10. A magnet as defined in claim 9, in which the sintered magnet has a mean crystal grain size of 3–15 microns.

11. A magnet as defined in claim 1 or 2, which contains 1 vol % or higher of a rare earth rich phase.

12. A magnet as defined in claim 2, in which M is at least one additional element selected from the group consisting of V, Nb, Ta, Mo, Cr and Al.

13. A magnet as defined in claim 1, in which, by atomic percent, R is 12–16 percent, B is 6–18 percent, and Fe is at least 66 percent.

14. A magnet as defined in claim 2, in which by atomic percent, R is 12–16 percent, B is 6–18 percent, Fe is at least 66 percent, and the additional element M is at least one selected from the group given below in the amounts not exceeding the atomic percentages specified below, wherein the sum of M is not exceeding the maximum value of any one of the values specified below for M actually added:

| | | | |
|---|---|---|---|
| 2.0% Al, | 1.0% Ti, | 2.0% V, | 1.4% Cr, |
| 1.7% Mn, | 1.1% Zr, | 0.9% Hf, | 1.7% Nb, |
| 1.7% Ta, | 2.2% Mo, | 1.3% Ge, | 0.3% Sb, |
| 0.5% Sn, | 0.7% Bi, | 1.0% Ni, | and 3.0% W. |

15. A magnet as defined in claim 13 or 14, which has a maximum energy product of at least 5 MGOe.

16. A magnet as defined in claim 1 or 2, which has a magnetic resonance of at least 4 kG.

17. A magnet as defined in claim 13 or 14, which has a magnetic remanence of at least 5 kG.

18. A magnet as defined in in claim 15, which has a magnetic remanence of at least 5.8 kG.

19. A magnet as defined in claim 15, which has a maximum energy product of at least 6 MGOe.

20. A magnet as defined in claim 19, which has a magnetic remanence of at least 6 kG.

21. A magnet as defined in claim 19, which has a maximum energy product of at least 7 MGOe.

22. A magnet as defined in claim 1 or 2, in which said tetragonal crystal structure has lattice parameters Ao of about 8.8 angstroms and Co of about 12.2 angstroms.

23. A magnet as defined in claim 1 or 2, in which R is Nd.

* * * * *